US005578386A

United States Patent [19]

Bell et al.

[11] Patent Number: 5,578,386

[45] Date of Patent: Nov. 26, 1996

[54] NICKEL COATED CARBON PREFORMS

[75] Inventors: James A. E. Bell, Oakville; Thomas F. Stephenson, Toronto, both of Canada

[73] Assignee: Inco Limited, Toronto, Canada

[21] Appl. No.: 338,262

[22] Filed: Nov. 10, 1994

Related U.S. Application Data

[60] Continuation of Ser. No. 122,784, Sep. 16, 1993, which is a division of Ser. No. 896,207, Jun. 10, 1992, which is a continuation-in-part of Ser. No. 781,758, Oct. 23, 1991, each , abandoned.

[51] Int. Cl.[6] ..... C22C 32/00; C22C 21/02

[52] U.S. Cl. ..... 428/614; 428/654; 428/658

[58] Field of Search ..... 428/614, 608, 428/654, 658

[56] References Cited

U.S. PATENT DOCUMENTS

| | | | |
|---|---|---|---|
| 3,547,180 | 12/1970 | Cochran | 428/614 |
| 3,600,163 | 8/1971 | Badia et al. | 75/135 |
| 3,608,170 | 9/1971 | Larson et al. | 428/545 |
| 3,720,257 | 3/1973 | Beutler et al. | 164/75 |
| 3,753,694 | 8/1973 | Badia et al. | 420/550 |
| 3,758,298 | 9/1973 | Eppich | 428/614 |
| 3,885,959 | 5/1975 | Badia et al. | 75/138 |
| 4,383,970 | 5/1983 | Komuro et al. | 428/614 |
| 4,409,298 | 10/1983 | Albertson et al. | 428/614 |
| 4,515,866 | 5/1985 | Okamoto et al. | 428/614 |
| 4,536,449 | 8/1985 | Kennedy et al. | 428/408 |
| 4,633,931 | 1/1987 | Yamaguchi et al. | 164/110 |
| 4,659,593 | 4/1987 | Rocher et al. | 164/97 |
| 4,681,817 | 7/1987 | Shinada | 428/549 |
| 4,708,104 | 11/1987 | Day et al. | 123/193 |
| 4,817,578 | 4/1989 | Ushio et al. | 428/614 |
| 4,906,531 | 3/1990 | Ohmura et al. | 428/614 |
| 4,909,910 | 3/1990 | Morin | 428/614 |
| 4,980,242 | 12/1990 | Yamamoto et al. | 428/614 |
| 5,041,340 | 8/1991 | Ushio et al. | 428/614 |
| 5,187,021 | 2/1993 | Vydra et al. | 428/614 |

FOREIGN PATENT DOCUMENTS

| | | | |
|---|---|---|---|
| 0332430 | 9/1989 | European Pat. Off. | 428/614 |
| 53-95813 | 8/1978 | Japan | 428/614 |
| 56-13780 | 3/1981 | Japan | 428/614 |
| 0116851 | 9/1981 | Japan . | |
| 58-81948 | 5/1983 | Japan . | |
| 60-46347 | 3/1985 | Japan . | |
| 58147532 | 9/1988 | Japan . | |
| 1-230737 | 9/1989 | Japan . | |
| 4-263030 | 9/1992 | Japan . | |

OTHER PUBLICATIONS

Translation of Japan 58–37142, Mar. 1983.

Surappa et al, "Production of Aluminum–Graphite . . . Particles", Metals Technology, Oct. 1978, pp. 358–361.

Petitcorps et al, "Chemical Analysis and Bonding at the Fiber–Matrix Interface in Model Aluminum Matrix Composites", Proceedings of the International Symposium on Advances in Cast Reinforced Metal Composites, Sep. 1988, pp. 67–70.

*Primary Examiner*—Ngoc-Yen Nguyen

*Attorney, Agent, or Firm*—Blake T. Biederman; Edward A. Steen

[57] ABSTRACT

The invention produces a light metal alloy composite having a nickel coated graphite or carbon with a nickel-containing intermetallic phase within a portion of a casting. A mold is provided to cast a light metal into a predetermined shape. A nickel coated carbon phase structure is placed into a portion of the mold. The light metal is cast into the mold around the carbon structure to wet an interface between the light metal and the nickel coated carbon structure. A nickel-containing intermetallic phase is formed in the light metal proximate the nickel coated carbon to provide increased wear resistance. The light metal is then solidified to form the metal matrix composite.

13 Claims, 6 Drawing Sheets

NICKEL COATED CARBON PREFORMS

This is a continuation of application U.S. Ser. No. 08/122,784, filed Sep. 16, 1993, now abandoned. U.S. Ser. No. 08/122,784 was a division of application U.S. Ser. No. 07/896,207, filed Jun. 10, 1992, now abandoned. U.S. Ser. No. 07/896,207 was a continuation-in-part application of U.S. Ser. No. 07/781,758 filed Oct. 23, 1991, now abandoned.

FIELD OF INVENTION

This invention relates to an improvement in unlubricated wear of bearing surfaces for such materials as aluminum and zinc.

BACKGROUND OF THE INVENTION

The use of nickel coated graphite particles was taught by Badia et al in U.S. Pat. Nos. 3,753,694 and 3,885,959. The nickel coated graphite particles provided improved machinability and wear resistance to aluminum castings. However, the process of Badia et al has disadvantages resulting from nickel coated graphite being dispersed throughout the aluminum casting. The graphite particles lower strength and related properties throughout the aluminum-base casting. Optimally, graphite particles are only placed at surfaces where increased wear and machinability properties are desired to minimize negative effects arising from graphite.

An additional technique for improving wear resistance of aluminum alloys is disclosed in U.S. Pat. No. 4,759,995 of Skibo et al. Skibo et al teach dispersion of SiC throughout aluminum castings. The SiC particles do not degrade strength properties as much as graphite. However, the process of Skibo et al also has disadvantages. The extremely hard surface of a SiC composite does not hold lubricant well or provide intrinsic lubrication properties. Thus, as a result of SiC composites poor ability to hold lubricant, SiC particles may actually increase unlubricated wear rate.

Another related technology for improving wear resistance relates to pressure injection molding or squeeze casting a preform constructed of a combination of carbon fibers and alumina fibers. The pressure injection method is disclosed by Honda in U.S. Pat. Nos. 4,633,931 and 4,817,578. According to the method disclosed in Honda, a combination of carbon and alumina fibers are dispensed and formed into a preform and placed into the desired area of the casting, i.e. on the inside of a cylinder wall of an internal combustion engine. The desired features of Honda's process are that it provides both a hard phase ($Al_2O_3$) for improved wear properties and carbon fiber for improved unlubricated wear properties. Furthermore, any degradation in strength is isolated to regions of the casting containing the fiber proform. However, the process disclosed by Honda requires a pressure of about 20 to 250 MPa applied to molten aluminum metal to infiltrate the preform of alumina and carbon fiber. This high pressure requirement causes the price of pressure injecting a preform to be very expensive.

It is the object of this invention to provide a low pressure method for producing a localized mixture of hard wear resistant particles and a lubricating carbon phase at the wear surface of a light metal casting.

SUMMARY OF THE INVENTION

The invention produces a light metal alloy composite having nickel coated graphite or carbon with a nickel-containing intermetallic phase within a portion of a casting.

A mold is provided to cast a light metal into a predetermined shape. A nickel coated carbon structure is placed into a portion of the mold. The light metal is cast into the mold around the carbon structure to wet an interface between the light metal and the nickel coated carbon structure. A nickel-containing intermetallic phase is formed in the light metal proximate the nickel coated carbon to provide increased wear resistance. The light metal is then solidified to form the metal matrix composite.

DESCRIPTION OF PREFERRED EMBODIMENT

Figure 1:
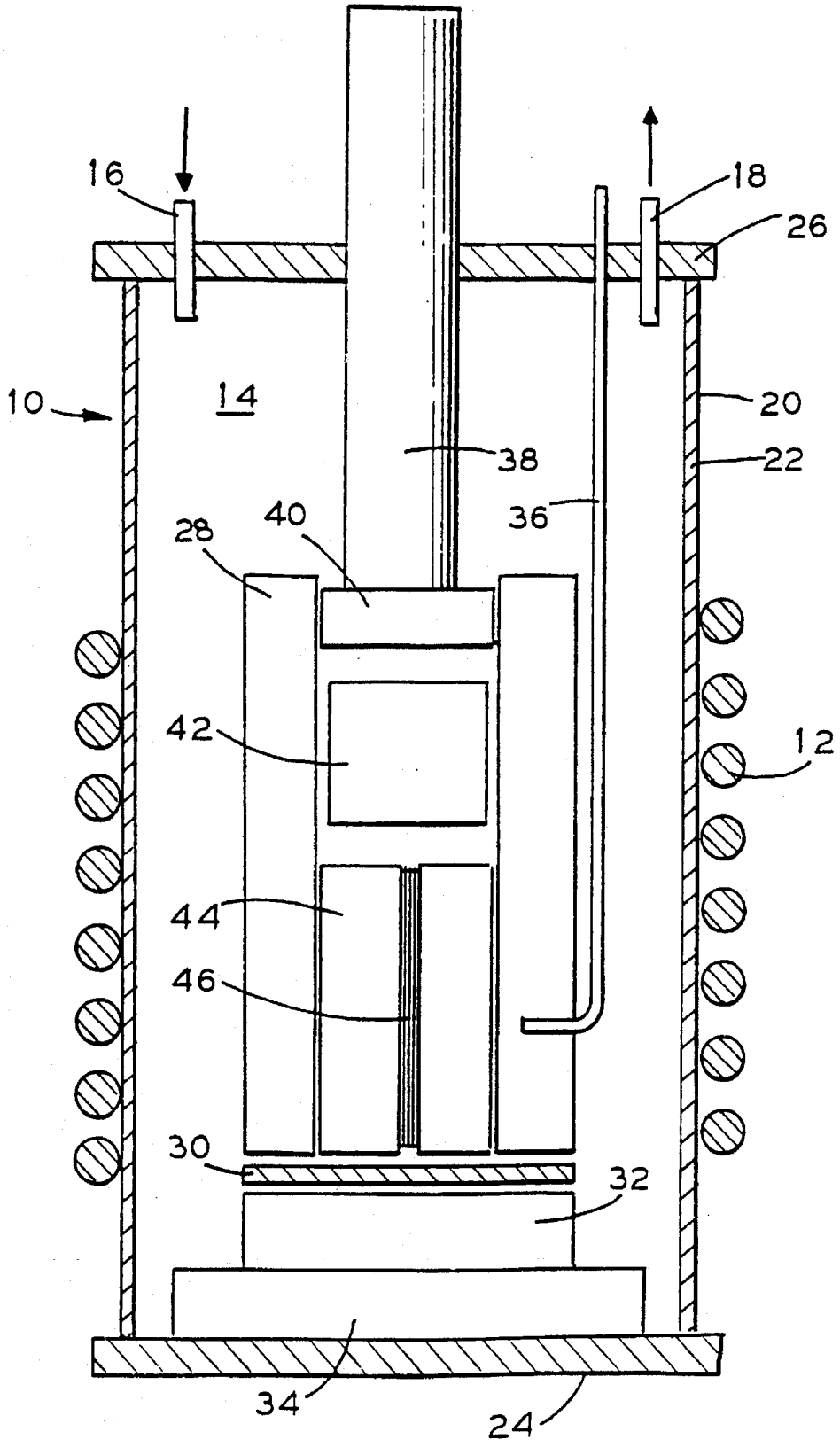
FIG. 1 is a schematic drawing of a pressure assisted infiltration unit for fabricating tensile and impact energy specimens.

This invention provides for the in situ formation of a hard phase in a softer injected metal phase at the wear surface of said cast part while at the same time providing the carbon lubricating phase. This invention provides an article and a low pressure method of fabrication of a cast part which contains a mixture of hard particles and carbon at the wear surface. Carbon is not distributed throughout the entire body of the casting.

The method of fabrication involves nickel coating on carbon structures such as carbon or graphite fibers, felt or paper, forming same into a preform shape, placing the preform in the desired place in the mold, then casting the part in a light metal. For purposes of this specification, carbon phase defines carbon, graphite and a mixture of carbon and graphite. A light metal is defined for purposes of this specification as aluminum, an alloy of aluminum, zinc, or an alloy of zinc. Specific examples of most advantageous aluminum-silicon alloys to be used with nickel coated carbon are the 300 series alloys provided in ASM Metals Handbook, Volume 2, Tenth Edition, pages 125–127 and 171. Most advantageously, aluminum-silicon alloys used for the method of the invention contain about 5 to 17 wt. % silicon for improved hardness. Examples of zinc alloys expected to operate with nickel coated carbon of the invention are zinc die casting alloys provided on pages 528–29 of the above-referenced Metals Handbook. During the casting or injection molding, the nickel coating provides a readily wettable surface to facilitate a modest or low pressure, i.e. about 0.7 Mpa to infiltrate the preform. The nickel dissolves off the fibrous or particulate preform as the molten Al or Zn or alloy thereof infiltrates the preform. The nickel metal reacts with the Al or Zn to form intermetallic compounds of $Al_3Ni$, AlNi, $Ni_2Al_3$, or $Ni_3Zn_{22}$ in situ inside of the fibrous preform. The nickel coating provides oxidation resistance and evolves heat during the phase transformation to nickel-containing intermetallics. The resultant preform ends up as a fibrous or particulate carbon phase, a hard nickel aluminide phase (or $Ni_3Zn_{22}$) in a matrix of the casting alloy. Advantageously, nickel-containing intermetallics are formed within 1 millimeter of the carbon structure. Most advantageously, the nickel-containing intermetallics are formed within 0.1 millimeter of the carbon structure.

The above composite, or method of manufacture of same, is particularly useful for production of engine liners and engine liner inserts. For production of engine liners, preforms arc placed into a mold and cast into the desired shape. For production of engine liner inserts, preforms are cast into cylindrical molds to form hollow composite cylinders that are subsequently cast into an engine block. A low infiltration pressure with improved wetting is used to provide a carbon phase for lubrication and a hard phase for improved wear resistance. The carbon phase and hard phase are only supplied where desired. For example, with piston liners and piston liner inserts, carbon phase and intermetallic phase is advantageously placed on the piston bearing surface.

Pressure caster 10 of FIG. 1 was used to evaluate various composites and methods for forming the composites. Referring to FIG. 1, pressure caster 10 was heated with induction coil 12 and maintained in an inert atmosphere 14. Most advantageously, an inert gas such as argon flows through gas inlet 16 and out gas outlet 18 to maintain a protective atmosphere for preventing excessive oxidation of liquid metals within housing 20. Housing 20 is preferably constructed with quartz tube 22 and end caps 24 and 26. Within housing 20, graphite mold 28 had a bottom seal 30, die cap 32 and cooling block 34 to provide a space for forming composites. Thermocouple 36 measured the temperature of graphite mold 28. Push rod 38 was used to drive plunger 40 which pushed liquid light metal alloy 42 into graphite die 44. Light metal was pushed between fibers 46 within graphite die 44 to form a test sample. The test sample was allowed to solidify as a metal matrix composite.

EXAMPLE 1(A)

Figure 2A:
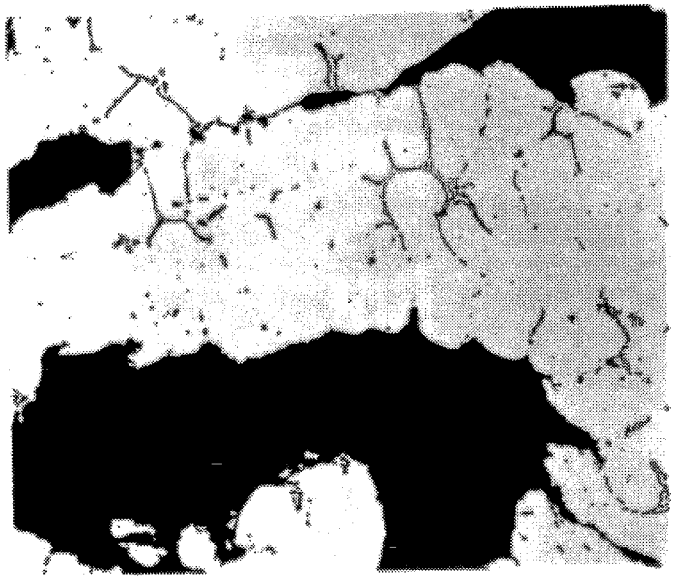
FIG. 2*a* is a cross-sectional photomicrograph of a carbon/aluminum composite reinforced with uncoated carbon fibers at 100X magnification.

A 12,000 filament tow of Hercules AS4 carbon fiber was placed in a 5 mm hole in a graphite die 44. A 2.5 cm diameter cylinder of pure aluminum 2.5 cm high was placed on top of the graphite die 44 and was enclosed in graphite mold 28 of FIG. 1. The apparatus of FIG. 1 was purged with argon, then heated by induction coils to 705° C. After 5 minutes, the aluminum was molten and a pressure of 4.5 MPa was applied to the plunger. A cross-section of the casting is shown in FIG. 2*a*.

EXAMPLE 1(B)

Figure 2B:
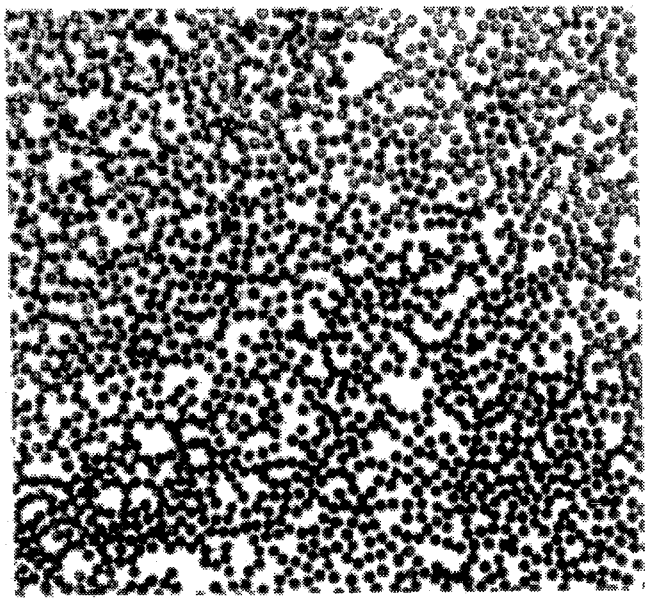
FIG. 2*b* is a cross-sectional photomicrograph of a carbon/aluminum composite reinforced with nickel coated carbon fibers at 200X magnification.

Example 1(A) was repeated except that the AS4 fiber was coated with 20 wt. % Ni prior to placing in the die. A cross-section of the casting is shown in FIG. 2*b*. From FIG. 2*b* it is apparent that the nickel coated carbon fibers were properly wetted by the molten aluminum while FIG. 2*a* shows that the uncoated carbon fiber was not wetted and tended to cluster together when the molten aluminum was infiltrated into the preform. Examples 1(A) and 1(B) illustrate the usefulness of the nickel coating to promote wetting of the carbon fiber by aluminum.

EXAMPLE 2

A series of composite cylinders were made by low pressure liquid infiltration of nickel coated carbon preform. The nickel coated carbon paper of felt used to make the preforms is described in a paper by Bell and Hansen presented at the Sampe Technical Conference, Lake Kianeska, N.Y., October 1991.

A carbon paper weighing 34 g/m$^2$ and containing approximately 97 percent voids was coated with 33 wt. % Ni. The paper was 0.3 mm thick and was cut and rolled around a solid graphite cylinder about 15 mm in diameter so that it formed a cylindrical preform with a wall thickness of 3 to 5 mm and a length of 75 mm. The solid graphite rod with the cylindrical preform on it, was placed inside a 23 mm I.D. stainless steel tube.

The stainless tube holding the preform was then placed in a Pcast 875L Pressure Infiltration Casting Machine and held at 400° C. The pure aluminum in the bottom of the apparatus was then heated to 700° C., then forced up into the preform by argon at 0.7 MPa (100 psi) pressure. The infiltration time was only a few seconds. When the thermocouples had indicated that the aluminum was solid, the composite was removed from the apparatus.

Figure 3B:
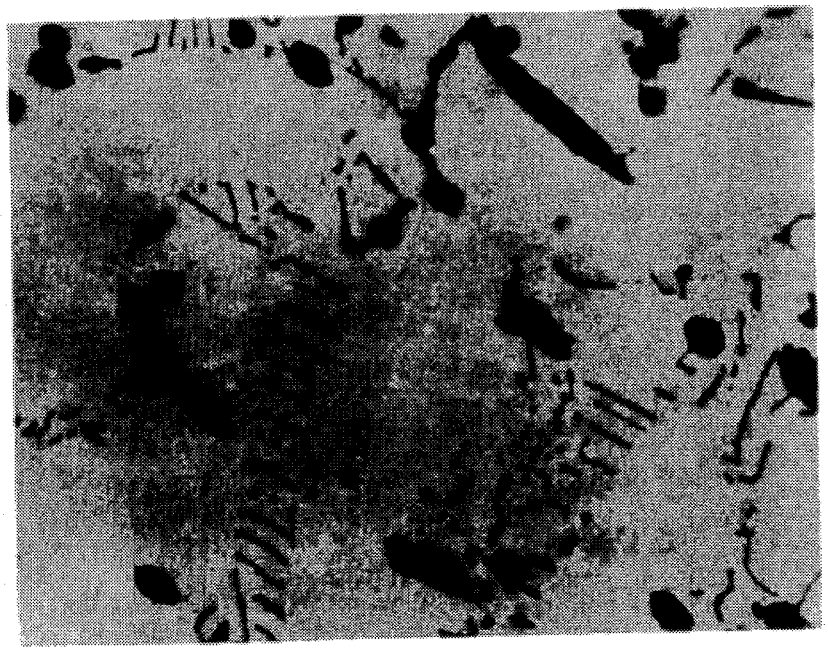
FIG. 3*b* is a photomicrograph of composite formed with nickel coated carbon paper at 500X magnification.
Figure 3A:
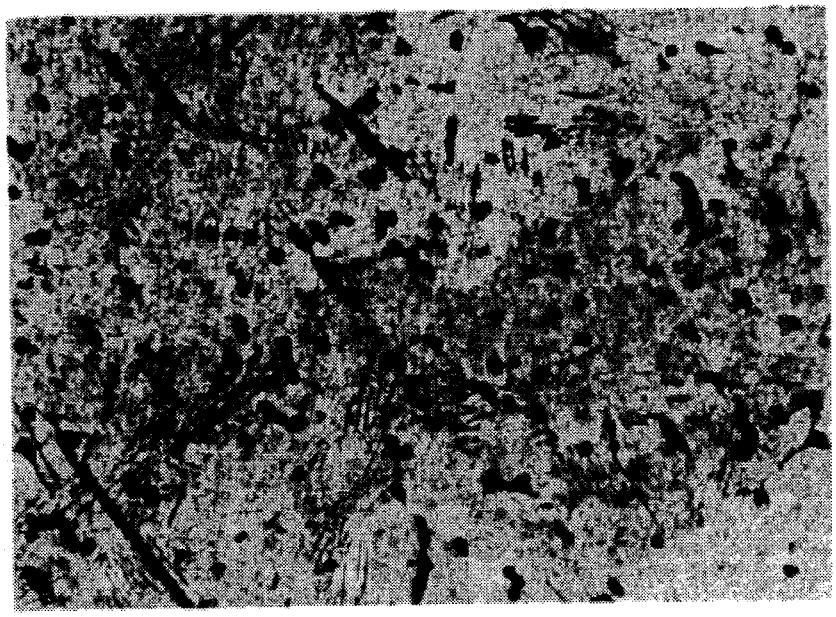
FIG. 3*a* is a photomicrograph of composite formed with nickel coated carbon paper at 200X magnification.

Optical micrographs of a cross-section of the composite are shown in FIGS. 3*a* and 3*b*. It is illustrated that most carbon fibers (black) are oriented parallel to the plane of the carbon paper and that they are evenly distributed throughout the aluminum matrix. Higher magnification (FIG. 3*b*) shows varying amounts of $Ni_xAl_y$ intermetallics adjacent to fiber surfaces.

These precipitates have been identified by semi-quantitative X-ray analysis as predominantly $NiAl_3$ as expected from the Ni-Al binary phase diagram.

The hardness of the pure aluminum was 11.8±0.6 on the HR-15T scale while the hardness of the composite inside the area of the preform was 45±3 on the same scale.

This example illustrates the principle features of the invention; namely, the nickel coating provides two essential properties; it provides for low pressure wetting of the carbon fiber by the infiltrating metal and modifies the alloy inside the volume of the carbon fiber preform so as to produce hard intermetallic compounds.

EXAMPLE 3

The process is not confined to the use of pure metals for infiltration.

A 97% porous nickel coated carbon felt (62 wt. % Ni) 2.3 mm thick was packed into 13 mm O.D. quartz tubes and infiltrated with a hypoeutectic Al-Si casting alloy A356 (7% Si; 0.3% Mg). The apparatus in Example 2 was used with a lower preform and melt temperature of 350° C. and 650° C. respectively.

Infiltration pressures were limited to between 1.05 MPa and 2.8 MPa (400 psi) (Ar). In general, the samples were less porous than the pure aluminum counterpart in Example 1(B) owing to slightly higher infiltration pressures and the increased fluidity of the Al-Si alloy. The normal cast structure of the A356 alloy is shown in FIG. 4*a* in an area remote from the preform.

Figure 4B:
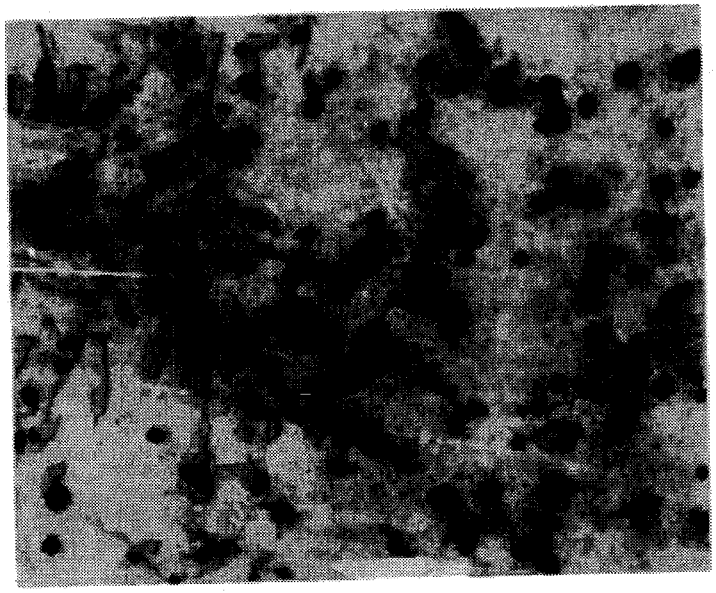
FIG. 4*b* is a photomicrograph of hypoeutectic Al-Si alloy A356 modified with nickel coated graphite at 200X.
Figure 4A:
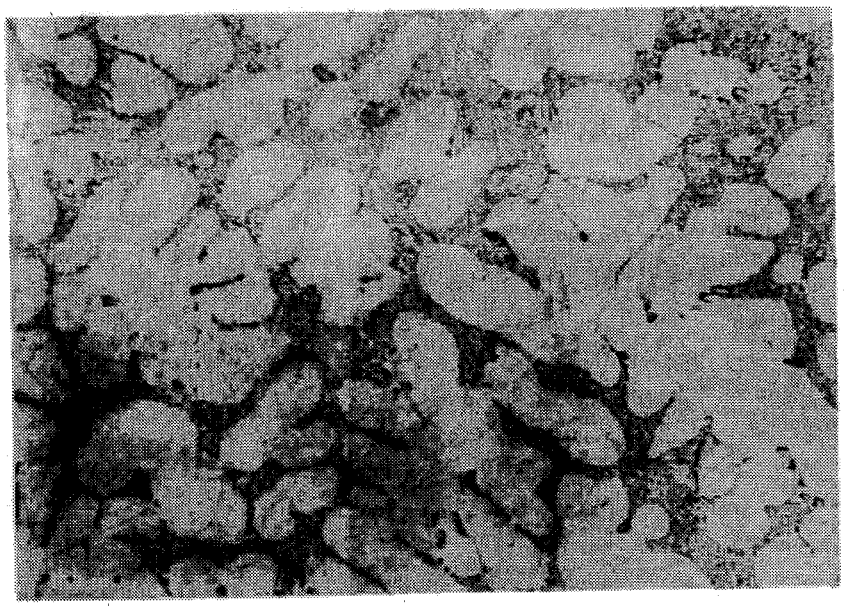
FIG. 4*a* is a photomicrograph of hypoeutectic Al-Si alloy A356 at 200X magnification.

FIG. 4*b* shows the distortion of the Al-Si eutectic inside the preform by the presence of the Ni from the graphite preform. The $NiAl_3$ phase is seen to be coarser than in the pure aluminum matrix of Example 2.

The hardness of the casting was essentially the same on the HR-15T scale of 70 for both the normal A356 alloy and the modified alloy inside the volume of the preform.

Figure 5:
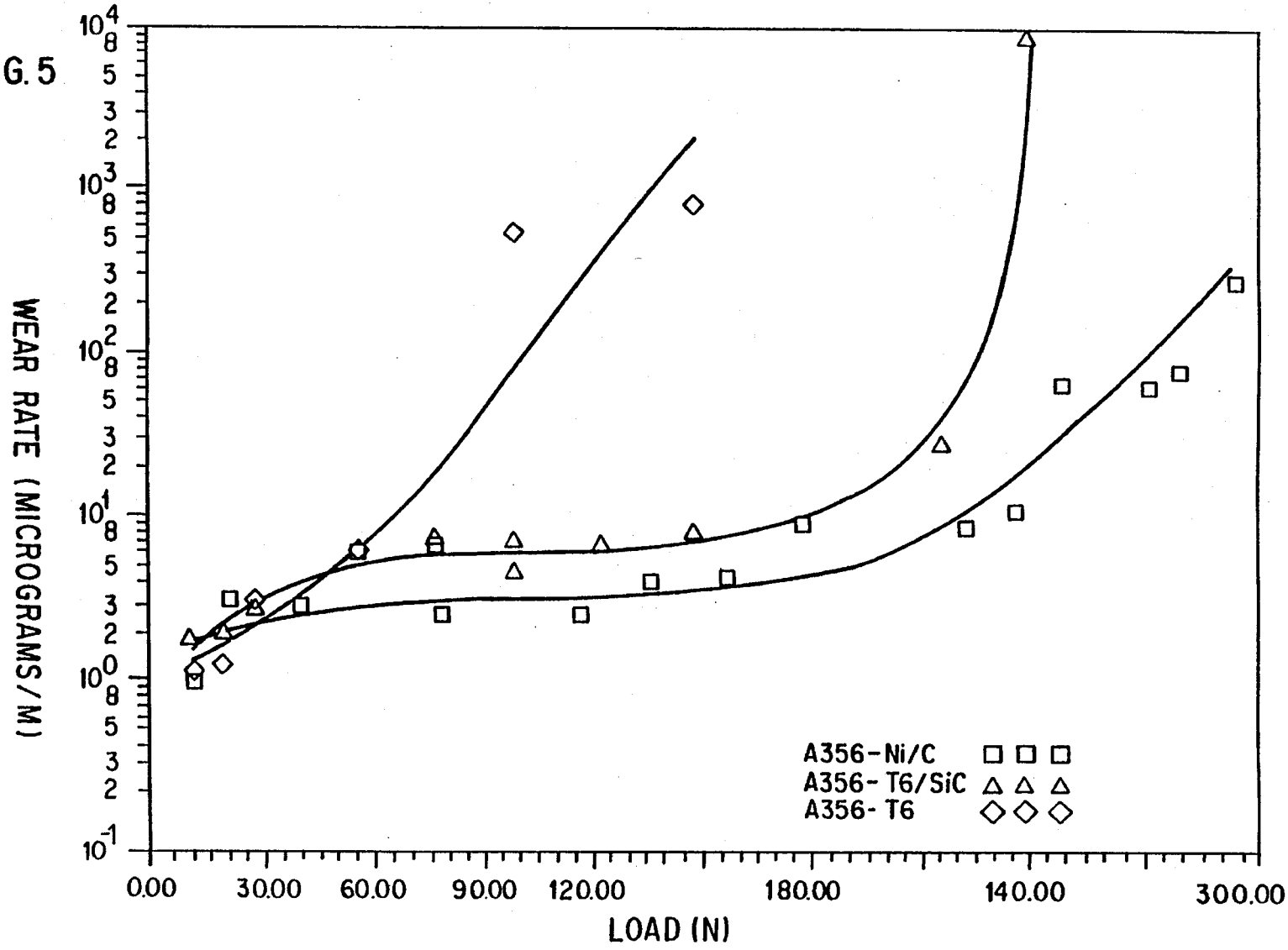
FIG. 5 is a graph of wear rate versus load for alloy A356, alloy A356 strengthened with SiC and alloy A356 strengthened with nickel-coated carbon paper.

Alloys A356, A356-20 vol. % SiC (F3A.20S as produced by ALCAN) and A356 nickel-coated carbon paper were tested in accordance with "Standard Practice for Ranking Resistance of Materials to Sliding Wear Using Block-on-Ring Wear Test," G77, Annual Book of ASTM Standards, ASTM, Philadelphia, Pa., 1984, pp. 446–462. Alloys A356 and A356-20 vol. % SiC were tempered with a T-6 condition to improve matrix strength. FIG. 5 compares the wear resistance of unreinforced A356 alloy with A356 matrices reinforced with SiC particulate or nickel-coated carbon paper. Both reinforced alloys exhibit superior wear resistance to unreinforced A356 over a load range representative of that in an internal combustion engine. The A356 nickel-coated carbon paper composite compares favorably to the SiC reinforced alloy and is noticeably more wear resistant at high load (>180 N). This is thought to be due not only to the lubricating qualities of graphite, but also the increased abrasion resistance of the $Al_3Ni$ intermetallic phase. Most advantageously, alloys of the invention are characterized by a wear rate of less than 10 micrograms/m at a load of 200 N for the Block-on-Ring Wear Test.

This example shows that the process and finished composite part can be produced by using an alloy in addition to pure metals. If an alloy like A356 is chosen for its low casting temperature and/or low coefficient of solid thermal expansion, the nickel coating also provides ease of wetting of the carbon preform and still modifies the microstructure of the alloy inside of the preform while maintaining or improving its hardness. The properties of the casting remote from the preform remain unchanged.

EXAMPLE 4

A hypereutectic Al-12Si alloy/nickel-coated graphite composite cylinder was squeeze-cast at a moderate pressure of 8.4 MPa (1200 psi). The preform was prepared by a method similar to Example 2 to give an outside diameter of 32 mm and a wall thickness of 3 mm. The nickel coated carbon preform was made from the same material present in Example 3. The melt temperature was 730° C.

Figure 6:
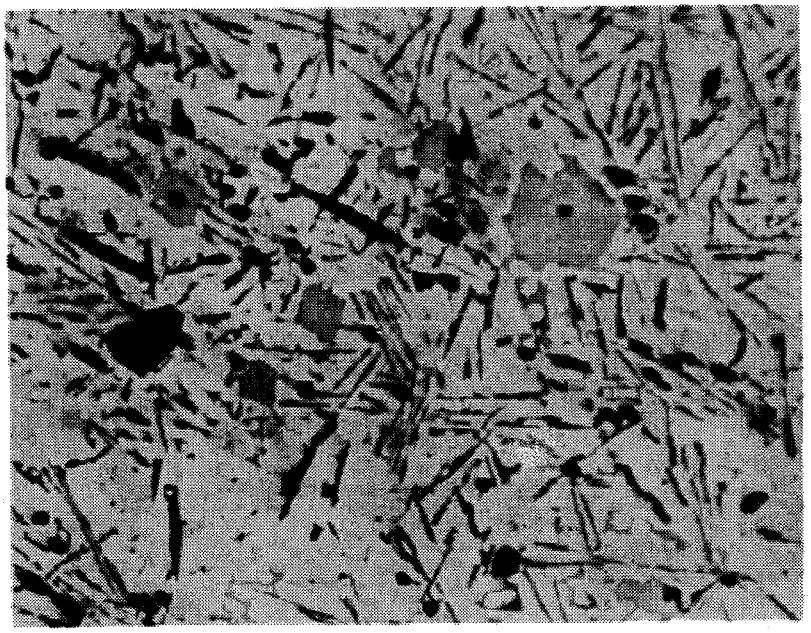
FIG. 6 is a photomicrograph of hypereutectic alloy Al-12 Si with nickel coated carbon fibers at a 200X magnification.

The microstructure depicted in FIG. 6 contained a large chunky intermetallic phase in addition to the acicular $NiAl_3$ precipitates also present in Example 3. These aluminides correspond to NiAl stoichiometry and are randomly dispersed in the distorted Al-Si matrix.

The normal acicular silicon phase has been suppressed and is mostly too fine to be observed in FIG. 6.

Again, since the silicon phase in the hypereutectic Al-Si alloys is hard, the hardness of the casting inside the area of the preform of 75 cm on the HR-15T scale was the same as the normal part of the casting. However, the microstructure of the casting inside the volume of the preform has been completely altered.

It has been discovered that it is most advantageous to preheat nickel coated carbon structures in an inert atmosphere when preheating nickel coated carbon structures at temperatures above about 300° C. Nickel oxidizes in air at temperatures above about 300° C. Nickel oxides reduce wetting and react with aluminum and aluminum-base alloys to form aluminum oxide scale which is believed to impede the formation of beneficial nickel-containing intermetallics.

The Examples have shown that the composite and method of the invention provide several advantages. First, the nickel coating improves wetting and reduces pressure required to infiltrate a carbon phase composite structure. Most advantageously, a pressure of only 35 KPa to 10 MPa is used which reduces equipment costs. Second, a graphite phase is provided for improved lubrication. Most advantageously, the carbon phase originates from either pitch or polyacrylonitrile precursor. Third, the invention provides a hard nickel-containing intermetallic phase such as $Al_3Ni$ or $Ni_3Zn_{22}$ for improved hardness adjacent to the nickel coated graphite. Most advantageously, graphite is coated with about 15 to 60 wt. % nickel or about 0.065 to 0.85 micrometers of nickel to promote formation of nickel-containing intermetallic phase. Optionally, alumina or nickel coated alumina may be added to the nickel coated carbon phase to further improve wear resistance. Fourth, the carbon phase and nickel phase are only placed where desired within a composite. The composite free region of the casting is free from unnecessary detrimental strength losses arising from carbon particulate. Fifth, the reaction between the nickel coating and the light metal alloy to form a nickel-containing intermetallic phase liberates heat. The preheat temperature required for the die and preform would therefore be reduced. Finally, the nickel coating protects the carbon fibers from oxidation. Uncoated fibers will burn in air at high temperatures greater than 350° C. resulting in the loss of carbon as gaseous carbon oxides and a corresponding loss in strength due to pitting of the fiber surface.

While in accordance with the provisions of the statute, there is illustrated and described herein specific embodiments of the invention, those skilled in the art will understand that changes may be made in the form of the invention covered by the claims and that certain features of the invention may sometimes be used to advantage without a corresponding use of the other features.

The embodiments of the invention in which an exclusive property or privilege is claimed are defined as follows:

1. A cast composite article consisting of a light metal matrix and a composite region within a portion of said light metal matrix, wherein said light metal matrix is an aluminum-silicon alloy and said composite region consisting of aluminum-base matrix, carbon phase fiber for providing lubrication, silicon phase and nickel-containing intermetallic phase precipitate, said composite region being formed by infiltrating said light metal matrix into a preform of said carbon phase fiber which was coated with 0.065 to 0.85 μm of nickel thereby causing the reaction between the nickel and the light metal matrix to form said nickel-containing intermetallic phase precipitate, said nickel being 15 to 60 weight percent of total nickel and carbon phase fiber, said nickel-containing intermetallic precipitate phase being within 1 millimeter of said carbon phase fiber provided by said preform, said composite region having a wear rate of less than 10 micrograms per meter at a load of 200 N for block-on-ring test G77.

2. The composite article of claim 1 wherein said aluminum-silicon alloy contains about 5 to 17 weight percent silicon.

3. The composite article of claim 1 wherein said carbon phase fiber is from nickel coated carbon felt.

4. The composite article of claim 1 wherein said carbon phase fiber is from nickel coated carbon paper.

5. The composite article of claim 1 wherein said composite is formed into an object selected from a group consisting of piston liners and piston liner inserts.

6. A composite article consisting of a light metal matrix and a composite region within a portion of said light metal matrix, wherein said light metal matrix is an aluminum-silicon alloy and said composite region consisting of aluminum-base matrix, carbon phase fiber for providing lubrication and nickel-containing intermetallic phase precipitate, silicon phase, said composite region being formed by infiltrating said light metal matrix into a preform of said carbon phase fiber which was coated with 0.065 to 0.85 μm of nickel, thereby causing the reaction between the nickel and the light metal matrix to form said nickel-containing intermetallic phase precipitate, said nickel being 15 to 60 weight percent of total nickel and carbon phase fiber, said nickel-containing intermetallic phase precipitate being within 1 millimeter of said carbon phase fiber provided by said preform, and said carbon phase fiber is from a structure selected from group consisting of nickel coated carbon felt and nickel coated carbon paper, said composite region having a wear rate of less than 10 micrograms per meter at a load of 200 N for block-on-ring test G77.

7. The composite article of claim 6 wherein said aluminum-silicon alloy contains about 5 to 17 weight percent silicon.

8. The composite article of claim 6 wherein said carbon phase fiber is from nickel coated carbon felt.

9. The composite article of claim 6 wherein said carbon phase fiber is from nickel coated carbon paper.

10. The composite article of claim 6 wherein said composite is formed into an object selected from a group consisting of piston liners and piston liner inserts.

11. A cast composite article consisting of a light metal matrix and a composite region within a portion of said light metal matrix, wherein said light metal matrix is selected from the group consisting of aluminum, aluminum-base alloys, zinc and zinc-base alloys and said composite region consisting of aluminum-base or zinc-base matrix, carbon phase fiber for providing lubrication and nickel-containing intermetallic phase precipitate for wear resistance, said composite region being formed by infiltrating said light metal matrix into a preform of said carbon phase fiber which was coated with 0.065 to 0.85 μm of nickel, thereby causing the reaction between the nickel and the light metal matrix to form said nickel-containing intermetallic phase precipitate, said preform is selected from the group consisting of nickel coated carbon felt and nickel coated carbon paper and said nickel being 15 to 60 weight percent of total nickel and carbon phase fiber, said nickel-containing intermetallic phase precipitate being within 1 millimeter of said carbon phase fiber provided by said preform.

12. The composite article of claim 11 wherein said light metal matrix is an aluminum-silicon alloy that contains about 5 to 17 weight percent silicon.

13. The composite article of claim 11 wherein said composite is formed into an object selected from a group consisting of piston liners and piston liner inserts.

* * * * *